US007543636B2

(12) United States Patent
Malone et al.

(10) Patent No.: US 7,543,636 B2
(45) Date of Patent: Jun. 9, 2009

(54) DIAGNOSTIC SLEEVE SHIFTING TOOL

(75) Inventors: Bradley P. Malone, Manhattan, KS (US); Jason Swaren, Sugar Land, TX (US); Thoros Heroian, Jr., Elk City, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 127 days.

(21) Appl. No.: 11/539,240

(22) Filed: Oct. 6, 2006

(65) Prior Publication Data

US 2008/0083533 A1 Apr. 10, 2008

(51) Int. Cl.
*E21B 47/00* (2006.01)
*E21B 34/14* (2006.01)

(52) U.S. Cl. ..... 166/252.4; 166/373; 166/386; 166/332.4

(58) Field of Classification Search ..... 166/250.01, 166/254.2, 373, 386, 53, 332.4
See application file for complete search history.

(56) References Cited

U.S. PATENT DOCUMENTS 2,726,848 A * 12/1955 Montgomery et al. ..... 175/321
4,254,832 A * 3/1981 Patton et al. ..... 166/332.4
4,917,191 A 4/1990 Hopmann
5,044,436 A * 9/1991 Magnani ..... 166/247
5,186,255 A * 2/1993 Corey ..... 166/250.15
5,305,833 A 4/1994 Collins
5,589,825 A * 12/1996 Pomerleau ..... 340/854.9
6,026,911 A * 2/2000 Angle et al. ..... 175/24
6,554,064 B1 * 4/2003 Restarick et al. ..... 166/250.01
6,684,951 B2 * 2/2004 Restarick et al. ..... 166/250.01
6,722,439 B2 4/2004 Garay
6,755,257 B2 6/2004 Spencer
6,799,633 B2 * 10/2004 McGregor ..... 166/250.01
6,953,094 B2 * 10/2005 Ross et al. ..... 166/381
6,961,663 B2 11/2005 Sinclair
6,983,795 B2 1/2006 Zuklic
7,134,493 B2 11/2006 Runia
7,150,318 B2 * 12/2006 Freeman ..... 166/255.1
7,303,010 B2 * 12/2007 De Guzman et al. ..... 166/255.1
2003/0085038 A1 * 5/2003 Restarick et al. ..... 166/278
2004/0055746 A1 * 3/2004 Ross et al. ..... 166/250.15
2005/0067563 A1 * 3/2005 Gilchrist et al. ..... 250/269.7
2005/0072577 A1 * 4/2005 Freeman ..... 166/386
2005/0126787 A1 6/2005 Gomez
2005/0199394 A1 * 9/2005 Schrenkel et al. ..... 166/254.2
2005/0288819 A1 * 12/2005 de Guzman ..... 700/245
2006/0054316 A1 * 3/2006 Heaney et al. ..... 166/250.01
2007/0272408 A1 * 11/2007 Zazovsky et al. ..... 166/278
2008/0065362 A1 * 3/2008 Lee et al. ..... 703/10

* cited by examiner

*Primary Examiner*—Shane Bomar
(74) *Attorney, Agent, or Firm*—Rodney Warfford; David Cate; Robin Nava

(57) ABSTRACT

A diagnostic tool which doubles as a sleeve shifting tool. The tool may include a diagnostic implement for measuring downhole conditions in a well such as flow-rate, pressure and temperature. Where the well includes a slidable or shiftable sleeve, the tool may be employed to slide such a sleeve for controlling communication between the well and an underground production region adjacent the location of the well. In this manner real time diagnostic assessment may occur at the well location in conjunction with means to affect the sleeve position. Thus, the need to run additional subsequent procedures with additional tools for affecting the sleeve position may be eliminated. As a result, substantial time and expense may be saved in conducting such well procedures.

13 Claims, 6 Drawing Sheets

DIAGNOSTIC SLEEVE SHIFTING TOOL

BACKGROUND

Embodiments described relate to well configurations and diagnostic tools employed therefor. In particular, embodiments of diagnostic tools are described that include the capacity to shift or slide a sleeve within a well over a perforation or aperture in order to close or open the access to the well thereat.

BACKGROUND OF THE RELATED ART

Exploring, drilling and completing hydrocarbon and other wells are generally complicated, time consuming and ultimately very expensive endeavors. This may be especially true in the case of certain wells where the configuration and environment of the well presents added challenges, such as in the case of horizontal or subsea wells.

In recognition of the potentially enormous expense of well completion added emphasis has been placed on well monitoring and maintenance over the years. That is, placing emphasis on increasing the life and productivity of a given well may help ensure that the well provides a healthy return on the significant investment involved in its completion. Thus, over the years, well diagnostics have become a more sophisticated and critical part of managing well operations.

Well diagnostic tools, often referred to as production logging tools, may be employed to analyze the condition of a well and its surroundings. Such logging tools may come in handy for performing diagnostics in the face of an unintended event. For example, in the case of an oil well, unintended sudden or significant water production may occur. In light of such an event, a logging tool may be employed to determine an overall production profile of the well. A logging tool may be used to obtain fluid hydrocarbon, gas hydrocarbons and water saturation values as well as data relative to the geology surrounding the well. As described below, logging data may even be taken from many segments of the well. Thus, a production profile of the entire well may be obtained along with an understanding of the contribution of various well segments to that overall profile and how they inter-act in the dynamic behavior of a well. As also described below, corrective maintenance may be performed on the well based on the results of the described logging application.

Unfortunately, running a logging tool through a well as indicated above requires that production from the well be shut off while a logging cable, with logging tool attached thereto, is lowered into the well. This may require well production to be shut off for six hours or more in a vertical well. Furthermore, in the case of horizontal or incline wells, common in the case of subsea wells, slower and more aggressive techniques such as coiled tubing may be necessary in order to advance the logging tool through the well for taking various measurements. Such a well may be shut off for 6-8 hours just to advance the logging tool through the well. Additional production time is then lost in performing analysis with the logging tool and thereafter removing the tool from the well.

Every production hour lost to the performance of other operations at the well, such as the described logging may be quite significant. For example, in the case of an offshore subsea well, the cost of any operation may exceed about $10,000 per hour whether productive in obtaining targeted fluids or not. Additionally, production time may be lost in taking corrective action following the logging application. That is, depending on the results of the logging application, certain sections of the well may need to be sealed off, for example to prevent water uptake as in the above noted scenario. Certain well features such as sliding sleeves may be employed to reduce this amount of additional time required to close off a well segment. However, even use of a sliding sleeve requires physical intervention by placement of a tool at the site of a sliding sleeve in order to manipulate its closure. Thus, a significant degree of additional production time and expense may be lost in taking the corrective action. As alluded to above, this expense is exacerbated in the case of horizontal, high angle, subsea or other wells of challenging access configurations. For example, a horizontal offshore well may be shut off for ten or more hours at a cost of several hundred thousand dollars in rig time and expense in order to run a logging application and take even minimal corrective action on the well such as effecting closure of a sliding sleeve.

SUMMARY

An apparatus is provided that includes a shaft with a diagnostic implement coupled thereto. The diagnostic implement may be used to establish a condition of a well. Additionally, a sleeve shifting device is coupled to the shaft in order to move a sleeve within the well based on the condition.

DETAILED DESCRIPTION

Embodiments are described with reference to certain hydrocarbon well configurations and diagnostic tools. However, tools employing a variety of diagnostic implements applied to a host of different well configurations may be employed. Regardless, embodiments described herein include a diagnostic tool having the capacity to shift or slide a well sleeve between an open and a closed state over a well perforation or aperture.

Figure 1:
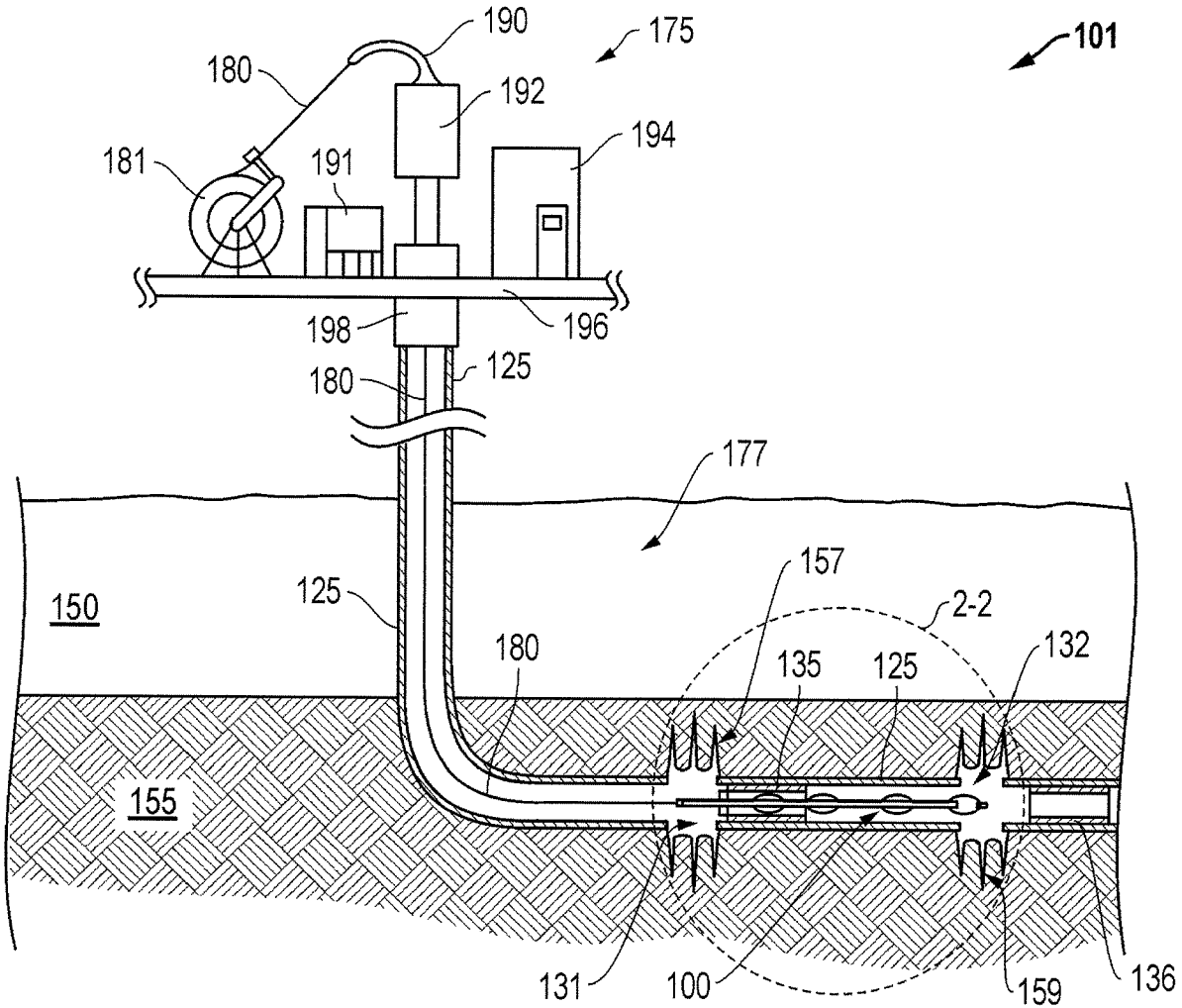
FIG. 1 is a side sectional overview of a well having a production assembly and a borehole assembly employing an embodiment of a diagnostic sleeve shifting tool.

Referring now to FIG. 1, an embodiment of a well 101 is shown. The well 101 includes a production assembly 175 coupled to a borehole assembly 177. In the embodiment shown, the well 101 is an offshore horizontal oil well as is apparent from the location of the production assembly 175 above the water 150 and the horizontal orientation of the borehole assembly 177 underground 155. However, embodiments described herein may be applicable to a variety of well types including production and injection wells, wherein production fluids include but are not limited to oil, gas, condensate and water, while injection well include but are not limited to water, gas and carbon dioxide. Nevertheless, use of an embodiment of a diagnostic sleeve shifting tool 100 may be of particular benefit for high angle (e.g. over about 55°), horizontal, offshore, or other wells of comparatively challenging accessibility.

In terms of challenging accessibility, the production assembly 175 for the offshore horizontal well 101 of FIG. 1 includes a production deck 196 to accommodate applications for dealing with the challenges of advancing tools through a tortuous borehole assembly 177. For example, a coiled tubing application may be employed whereby coiled tubing 180 is drawn from a tubing reel 181 and advanced through a gooseneck guide 190 by an injector head 192. In certain applications, the coiled tubing 180 may be directed beyond a production tree 198 with enough force to actually drill underground 155. Thus, in the embodiment shown, the coiled tubing 180 may be directed with enough force to advance a diagnostic sleeve shifting tool (DSST) 100 through the tortuous borehole assembly 177. In an alternate embodiment, however, a conventional jointed tubing or a wireline with a tractor mechanism may be employed in place of the coiled tubing 180 for moving the DSST 100.

Continuing with reference to FIG. 1, the production assembly 175 may also include a control unit 194 with user interface, power unit 191 and other conventional production assembly features and tools. As indicated above, a production tree 198 is located below the production deck 196 where a variety of application hook-ups may be coupled. For purposes here, a single borehole assembly 177 is shown coupled to the production tree 198. However, in other embodiments a variety of assemblies for any number of particular applications may be coupled to the production tree 198.

The borehole assembly 177 couples to the production tree 198 with a borehole casing 125 extending downward through the water 150 below the offshore well 101 and underground 155. In the embodiment shown, the borehole casing 125 lines a borehole that extends horizontally as alluded to above. This is not an uncommon occurrence in the case of an offshore well 101. However, as also alluded to above, the horizontal nature of the borehole assembly 177 presents a tortuous path for advancement of a DSST 100 or other tools. As a result, advancement of such devices may be achieved with an aggressive application such as the described coiled tubing deployment technique. In other embodiments, advancement of such tools may be achieved with jointed tubing or conventional tractor applications, for example, to achieve downward sleeve opening as described further below.

Regardless of the particular application employed, advancement and retrieval of a tool through an entire borehole assembly may take between about 6 and about 24 hours depending on factors such as the task to be performed by the tool, the extent and tortuousness of the borehole assembly 177, and the particular application employed for advancement and retrieval of the tool. Thus, the significance of efficient and proper performance of the tool along with its efficient advancement and retrieval may be seen. This may be especially important in the case of a high angle or horizontal well 101 as shown, where longer advancement and retrieval times may inherently be involved. For example, it may take more than two to four times as long to advance and retrieve a tool through a tortuous well 101 as shown, as compared to a substantially vertical well.

The significance of the above described time and expense involved, may be magnified where erroneous performance by an inserted tool results in the need to repeat the procedure, once again shutting off targeted fluid production by the well 101 for an extensive period of time. Thus, as described below, any reduction in the amount of time the well 101 is shut down for such procedures may be of great benefit. Such benefit may be afforded by use of a DSST 100 as described further below.

Continuing with reference to FIG. 1, the underground 155 portion of the well 101 reveals production regions 157, 159 adjacent the horizontal portion of the borehole casing 125. Perforations or apertures 131, 132 in the borehole casing 125 are provided adjacent the production regions 157, 159. In this manner, the well 101 may be provided with access to targeted fluids such as hydrocarbons which may be contained underground 155. A variety of hydrocarbon and other gas or liquid fluids, may be accessed underground 155 by such a well 101. Additionally, while only two production regions 157, 159 and corresponding apertures 131, 132 are shown, the well 101 is likely to extend through numerous additional production regions (not shown) before terminating. In fact, the well 101 may extend for several miles traversing potentially dozens of production regions from which targeted fluids may be drawn. Furthermore, these regions 157, 159 appear to be fairly close to one another in FIG. 1. However, such production regions 157, 159 may be as much as a mile apart or more.

The above described production regions 157, 159 including those not necessarily shown in FIG. 1, each contribute an individual amount to the overall production of the well 101. For example, a first production region 157 may contribute a first amount of targeted fluid to well operations while a second production region 159 may contribute a second amount. These amounts may vary from one region (i.e. 157) to the next (i.e. 159). However, added together an overall production profile for operations at the well 101 may be established.

As indicated above, potential disparity between the contributions of the above noted production regions (i.e. 157, 159) may be present. Nevertheless, the overall production profile for operations at the well 101 may be at an optimum, with each production region positively contributing thereto. However, in certain circumstances an event may arise in which production at a given production region (i.e. 157, 159) is compromised, perhaps even to the point of adversely affecting the overall production profile for the well operations. Note that in some instances the regions 157, 159 may not be producing at all or may be taking in fluid. Embodiments of the DSST 100 may also be useful in these areas of the well. For example, upon detection of such an area the DSST 100 may be used to open an adjacent sleeve 135, 136 and run a confirmation log to determine the affect of the sleeve closing.

By way of example, in an embodiment where the targeted fluid is a hydrocarbon, an adverse event such as water leakage into the first production region 157 may occur. This is a common scenario for nearly all maturing production well(s) 101. Nevertheless, such water leakage may be to the point that the overall production profile of well operations is adversely affected. In fact, it may take no more than about 10% water production by the well 101 as a whole in order to render production operations at the well fruitless. Thus, as described below, rather than cease operations at the well 101 altogether, it may be advantageous to close off the first production region 157 in order to optimize or restore effective production of the targeted hydrocarbon. In fact, as a preventative and optimizing measure, this may be done when no more than about 5% water production is encountered. Closing off the production region 157 or 159 may be achieved by closure of a corresponding sleeve 135 or 136, respectively, adjacent thereto, as detailed further below. At a later date in the life cycle of the well 101, it may be deemed economical and prudent to reopen a sliding sleeve 135, 136 producing at high water percentage as higher variations in produced fluids may be tolerable. The DSST 100 would be used at each of the decision points in the life of the well 101.

In the above hypothetical scenario, an example of an event at the first production region 157 is described. In practice, however, it would be likely that the particular region of the event would be unknown, at least initially. For example, from the standpoint of operators at the production assembly 175, an event may present itself as a fairly sudden change in the production profile of well operations. In the example provided this might be the sudden emergence of water production adversely affecting the production of targeted hydrocarbons. However, the location of such water production may not readily be apparent. Therefore, a logging tool such as the DSST 100 may be employed for surveying the borehole assembly 177 to determine the site of the event as described further below. The DSST 100 may also be used to obtain fluid hydrocarbon and water saturation values as well as data relative to the geology surrounding the well 101. In one embodiment the DSST 100 is capable of measuring all fluids and gases, and can determine if a given fluid is water, gas or oil and the velocity and/or rate of each phase. The DSST 100 may also be configured to determine the location (segregation) of the fluid (gas) type in the well bore. This can be determined at any location in the well 101.

Figure 2:
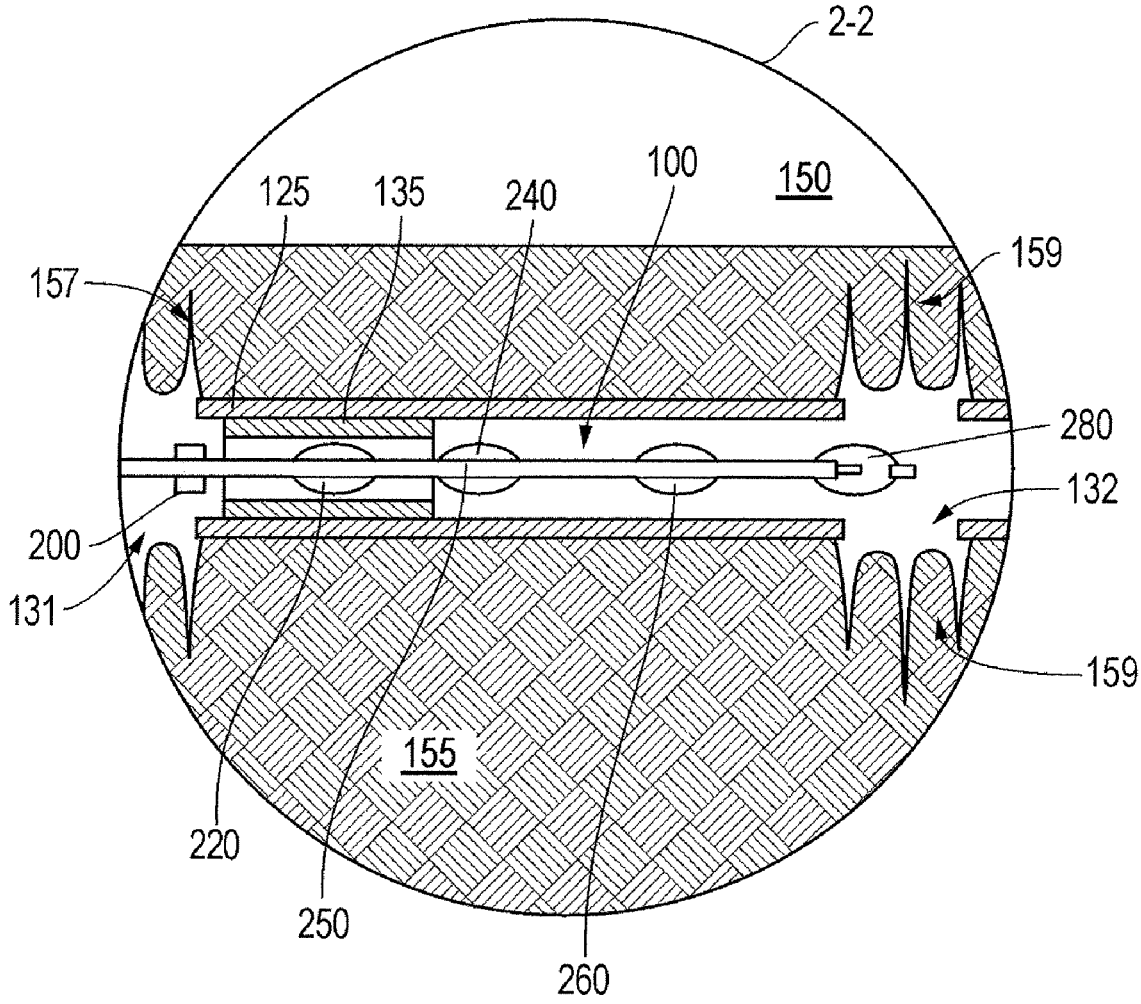
FIG. 2 is an enlarged view of the diagnostic sleeve shifting tool within the borehole assembly taken from section lines 2-2 of FIG. 1.

Continuing with reference to FIGS. 1 and 2, the DSST 100 is shown advancing within the borehole casing 125 to the production regions 157, 159. The DSST 100 may include a shaft 250 equipped with a variety of diagnostic implements (220, 240, 260, 280) to establish conditions of the well 101 within the borehole casing 125. For example, a saturation implement 220 may be provided to obtain water flow information. An ejector implement 260 may be employed in conjunction with the saturation implement 220. That is, the ejector implement 260 may eject a non-radioactive marker for detection by the saturation implement 220 in establishing water flow information. Other diagnostic implements may include an imaging implement 240 as well as a fullbore spinner implement 280 to measure fluid velocity. Additionally, a variety of other diagnostic implements may be accommodated by the DSST 100 for establishing pressure, temperature or other well conditions. In one embodiment, the DSST 100 may include any means of obtaining logging information at the production regions of interest.

In the case of an event, such as the above noted water production, recovery of targeted fluids by the production assembly 175 may be temporarily terminated. In the embodiment shown, coiled tubing 180 with the DSST 100 assembled thereto may then be advanced through the borehole assembly 177. Alternatively, a conventional, and potentially more economical, tractor advancing mechanism may be employed. As indicated above, the DSST 100 may be advanced while acquiring data relative to each segment of the borehole assembly 177 including those immediately adjacent regions 157, 159 as well as those less directly adjacent such regions 157, 159. A survey of the borehole assembly 177 to acquire data in this manner may be referred to as logging.

Typical logging and follow on sleeve shifting procedures as described above may take ten hours or more at considerable expense given the loss of targeted fluid production during this procedure time. Therefore, the benefit of employing a DSST 100 that eliminates the introduction of a separate sleeve shifting tool and procedure may be quite significant as detailed below. That is, embodiments of a DSST 100 may be configured to eliminate the need for running a wholly separate follow on sleeve shifting procedure in order to close a sleeve 135, 136 once the site of the water leak is established. As a result, potentially tens, and in some cases hundreds, of thousands of dollars in cost for rig and operation time required by the use of a conventional separate sleeve shifting procedures may be avoided.

Continuing with reference to FIGS. 1 and 2, logging of the entire borehole assembly 177 with the DSST 100 as indicated above may provide operators with critical information. For example, such a logging procedure may be used to identify the source of an undesirable event such as the above noted water leakage. That is, in the above hypothetical scenario, an example of an event at the first production region 157 is described where water may be leaking through a first aperture 131. Water leaking into the borehole casing 125 in this manner may significantly impair production of targeted fluids. Therefore, the shaft 250 of the DSST 100 is equipped with a sleeve shifting device 200 in order to effect closure of a first sleeve 135 over the first aperture 131 to stop the indicated water leakage into the borehole casing 125. As described further herein, it is this sleeve shifting device 200 which provides significant time and cost savings by eliminating the need to advance a separate sleeve shifting tool to the first aperture 131 to achieve closure of the first sleeve 135.

Figure 3A:
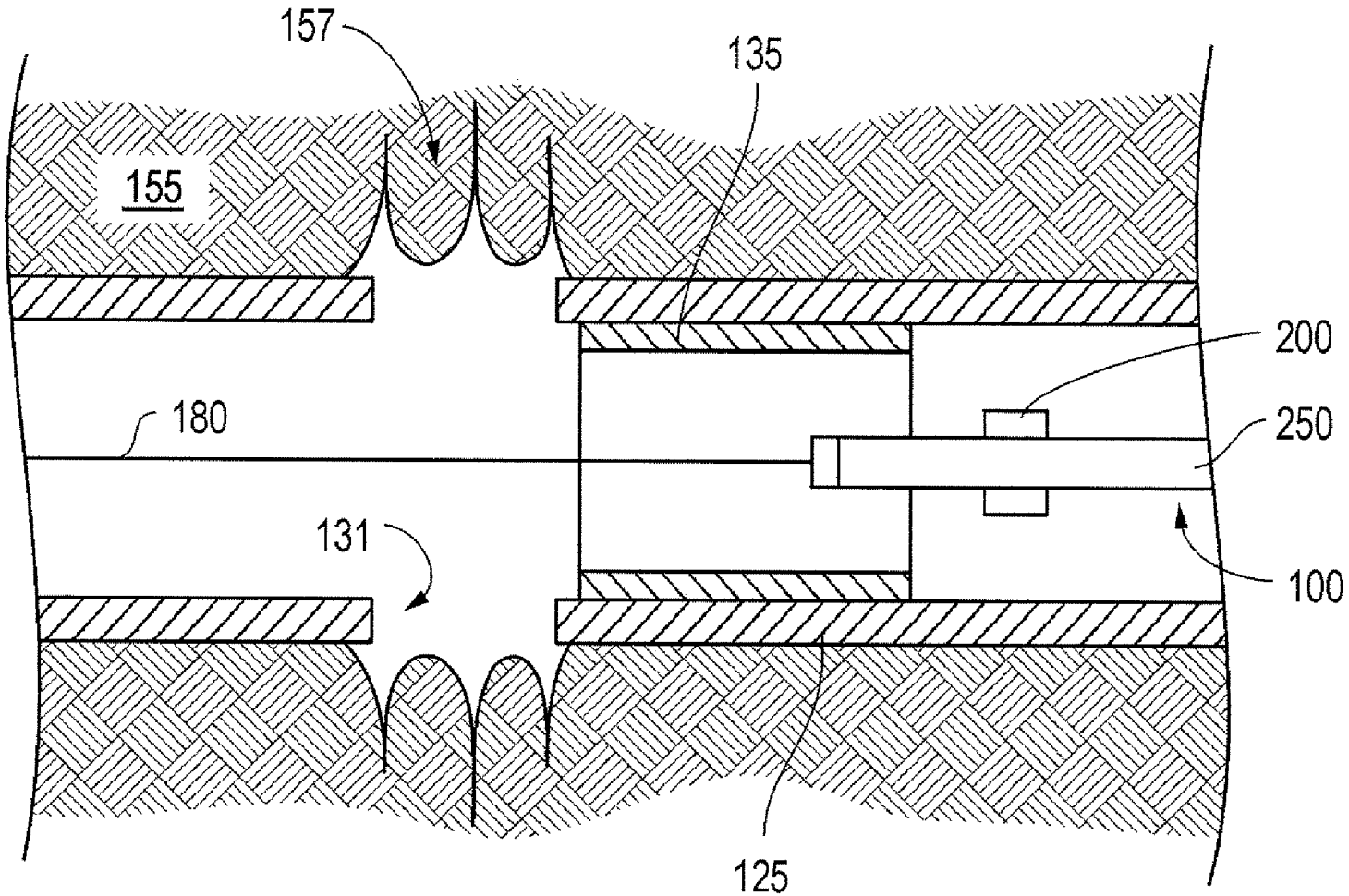
FIG. 3A is a side cross sectional view of the diagnostic sleeve shifting tool of FIG. 2 positioned with an engagement mechanism thereof relative to a sleeve of the borehole assembly.
Figure 3B:
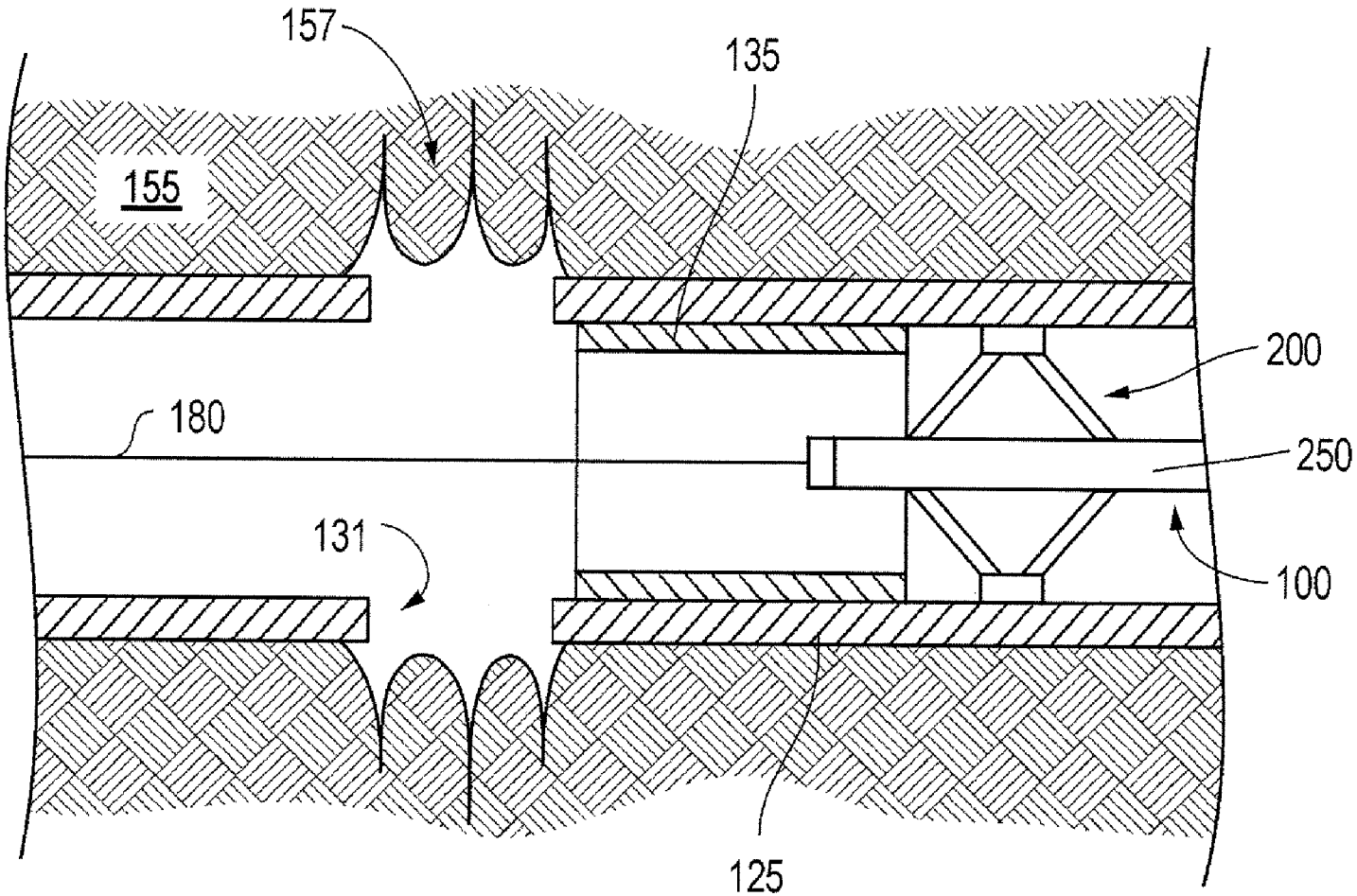
FIG. 3B is a side cross sectional view of the diagnostic sleeve shifting tool of FIG. 3A with engagement mechanism actuated for engagement of the sleeve.
Figure 3C:
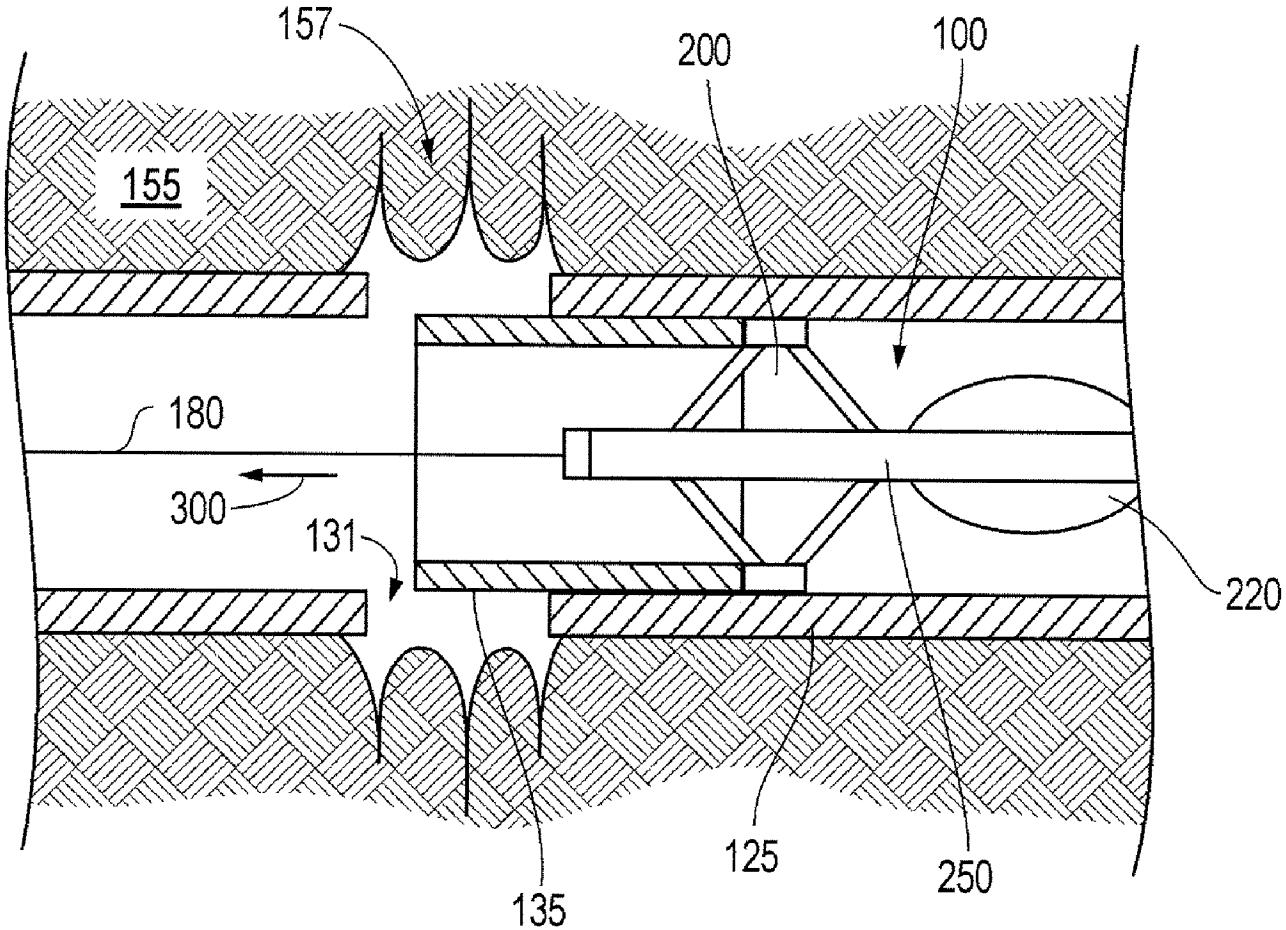
FIG. 3C is a side cross sectional view of the diagnostic sleeve shifting tool of FIG. 3B engaged with and moving the sleeve via the engagement mechanism.
Figure 4:
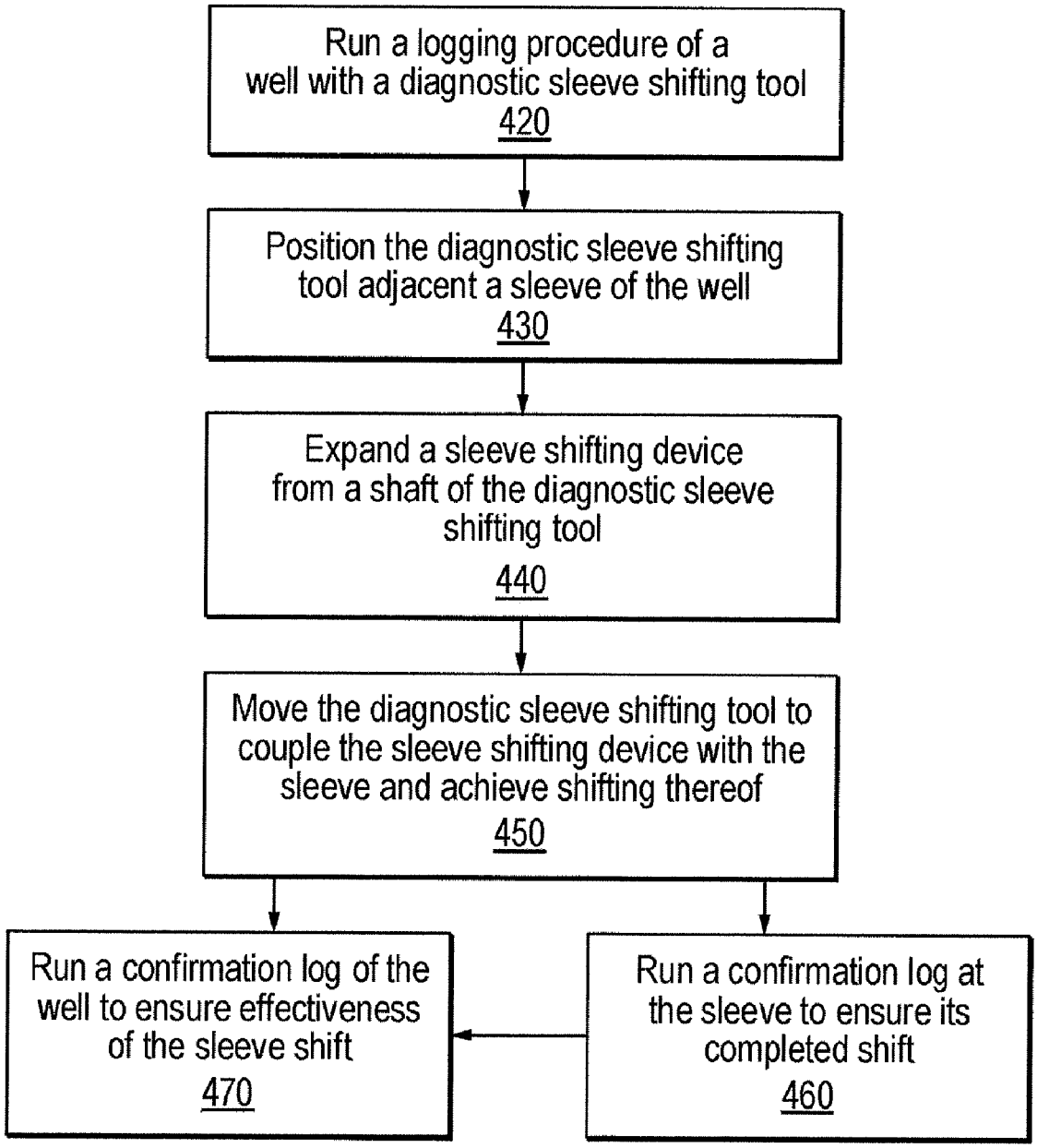
FIG. 4 is a flow chart summarizing an embodiment of employing a diagnostic sleeve shifting tool to perform diagnostics on, and move a sleeve of, a well borehole assembly.

Referring now to FIGS. 3A-3C, and with added reference to the flow-chart of FIG. 4, a method of moving a sleeve with the DSST 100 is shown. That is, with reference to the water leakage scenario noted above, a single DSST 100 may be employed for both running a logging procedure and for closing a first sleeve 135 over a first aperture 131 to prevent water leakage into the borehole casing 125 from the first production region 157. With reference to FIG. 3A, the DSST 100 may be advanced throughout the borehole casing 125 of a well in running a logging procedure as described above and indicated at 420. Once the water leakage information is established by the logging procedure, the DSST 100 may be drawn from the terminal end of the borehole casing 125 and toward the first sleeve 135. As shown in FIG. 3A and indicated at 430, the sleeve shifting device 200 is positioned adjacent the first sleeve 135, slightly downhole thereof. In this manner, the sleeve shifting device 200 may be expanded, allowing further movement of the DSST 100 to close the first sleeve 135 as detailed below. In the embodiment of FIGS. 3A-3C, the positioning and movement of the DSST 100 is achieved via coiled tubing 180 as described further below. However in an alternate embodiment a conventional tractor mechanism, or another appropriate means, may be employed to achieve movement of the DSST 100.

Referring specifically to FIG. 3B, the sleeve shifting device 200 is shown expanded from the shaft 250 of the DSST 100 adjacently downhole of the first sleeve 135 as indicated above. Precise positioning of the DSST 100 and sleeve shifting device 200 may be confirmed by an implement of the DSST 100 such as the imaging implement 240 or other locating device (see FIG. 2). Once positioned as indicated, an operator may send an electronic signal via wire or fiber optic cable to the DSST 100 for expansion of the sleeve shifting device 200 as shown. Expansion may be achieved physically by conventional means such as hydraulics. In one embodiment, expansion of the sleeve shifting device 200 may occur in an automated fashion via a control unit 194 or other mechanism having the capacity to take advantage of logging information obtained during the logging procedure.

Referring now to FIG. 3C, the DSST 100 with expanded sleeve shifting device 200 is shown being drawn from the borehole casing 125 in an uphole direction (see arrow 300). That is, the coiled tubing 180 is being retracted via conventional means at the production assembly 175 of FIG. 1. Retraction of the coiled tubing 180 in this manner forces the expanded sleeve shifting device 200 into contact with the first sleeve 135. Thus, given the sliding or shifting nature of the first sleeve 135, it is drawn over the first aperture 131 in order to close off the first production region 157 as indicated at 450. In this manner water leakage into the borehole casing 125 from the first production region 157 may be terminated. In one embodiment, a diagnostic implement of the DSST 100 is employed at this time to confirm the cessation of water leakage. As indicated at 460, such a confirmation log may help ensure that the intended shifting of the sleeve 135 and closure of the first aperture 131 has occurred.

Once closure of the first aperture 131 is achieved, the sleeve shifting device 200 may be retracted back toward the shaft 250 allowing complete removal of the DSST 100 from within the borehole casing 125. Once again, closure of the first aperture 131 and retraction of the sleeve shifting device 200 may be achieved manually or in an automated fashion which takes advantage of logging information obtained during the initial logging procedure.

The above described method of employing the DSST 100 details closure of a sleeve 135 by retraction of coiled tubing 180. However, in another embodiment a closed sleeve, similar to the first sleeve 135 may be opened by positioning the DSST 100 and sleeve shifting device 200 slightly uphole of the sleeve 135 and advancing the coiled tubing 180 downwardly. Additionally, in an alternative configuration of the borehole assembly 177, opening and closing of a sleeve may take place in an opposite direction to the embodiments shown herein. For example, in such an alternate configuration, an expanded sleeve shifting device 200 may close a sleeve over a more downhole aperture by positioning the DSST 100 uphole of the sleeve and advancing there-toward. Similarly, opening of such an aperture may be achieved by positioning the DSST 100 slightly downhole of the sleeve and retracting the expanded sleeve shifting device 200 theretoward. The above described techniques of employing the DSST 100 may be employed to close off a water leak at the first production region 157. As a result, the overall production profile of the well 101 may be optimized and the DSST 100 removed as indicated above. However, in one embodiment, the DSST 100 is employed to perform diagnostics both before and after sleeve shifting procedures as indicated at 470. That is, diagnostics may point to a particular production region 157 as the source of an event. However, it is possible that in order to achieve an optimum production profile, multiple sleeves may need to be shifted as described. In such circumstances, logging information may require updating after initial sleeve shifting procedures in order to determine subsequent sleeve shifting procedures that may be desired. Furthermore, even where this is not the case, it may be worthwhile to confirm the accuracy of the logging information while the DSST 100 remains within the borehole assembly 177. That is, this may be preferable to shutting down production to re-run DSST 100 procedures in the unfortunate event that a single application of these procedures failed to optimize the overall production profile of the well 101.

As indicated above, logging information may be used to allow operators to take corrective action in the face of an undesirable event. However, such logging information may also be employed in order to further optimize the overall production profile over the life of the well 101. For example, a well 101 may be configured with numerous sleeves adjacent numerous production regions as noted above. At the outset of operations at the well 101 many of the sleeves may be open and many others closed, the status of each determined based on the particular conditions present at each production region at the outset of operations. For example, in one scenario the pressure present at several downhole production regions at the outset of operations may be minimal compared to the majority of the remaining production regions. Therefore, rather than allow these downhole production regions to potentially siphon off targeted fluids, they may initially be closed off by adjacent sleeves. However, over the life of the well 101, pressure at the remaining production regions may naturally decrease to about that of the downhole production regions. Confirmation of this fact and corresponding opening of the downhole production regions may be achieved in a single application of the DSST 100 as described above. Thus, the DSST 100 may be employed as a valuable management tool throughout the life of the well, not limited to use during more sudden undesirable events.

The embodiments described herein provide a diagnostic sleeve shifting tool that eliminates the need for running an entirely separate sleeve shifting procedure and tool through a well once determining that a particular sleeve or sleeves of the well need to be shifted. Employment of such a diagnostic sleeve shifting tool may save considerable time and expense, perhaps even in the tens or hundreds of thousands of dollars range. This is due to the significant savings in production and equipment operation time that may be achieved by employing a single tool capable of both performing logging applications and follow-on sleeve shifting. Furthermore, the effectiveness of sleeve shifting may be established in real time by diagnostic implements of the tool while sleeve shifting capability remains in the well (i.e. also with the tool). Thus, additional cost savings may be experienced in the form of improved effectiveness of diagnostic and sleeve shifting operations. Furthermore, while exemplary embodiments described, other embodiments are possible. Additionally, many changes, modifications, and substitutions may be made without departing from the scope of the described embodiments.

We claim:

1. A method comprising:

advancing a diagnostic tool through a well;

running a first log with the diagnostic tool to determine a first condition of the well;

employing the diagnostic tool to move a sleeve within the well relative to an aperture in a casing thereof, the aperture located to provide fluid communication with a production region adjacent to the casing; and executing a confirmation log with the diagnostic tool to determine a second condition of the well indicative of an affect on the communication by said employing.

2. The method of claim 1, wherein the diagnostic tool moves the sleeve based on the first condition.

3. The method of claim 1, wherein each of said running of the first log and said executing of the confirmation log comprises measuring one of water flow, fluid velocity, pressure, and temperature, fluid saturation and other formation parameters.

4. The method of claim 1, further comprising withdrawing the diagnostic tool from the casing.

5. The method of claim 4, wherein said employing, said executing, and said withdrawing are achieved in an automated manner.

6. The method of claim 1 further comprising:

positioning a sleeve shifting device of the diagnostic tool adjacent the sleeve; and manipulating the sleeve shifting device for contacting the sleeve prior to said employing.

7. The method of claim 1, wherein said advancing employs one of a coiled tubing assembly, a jointed tubing assembly, and a tractor mechanism.

8. A method comprising:

advancing a diagnostic tool through a borehole casing of a well;

establishing a production profile of substantially the entire well with substantially the diagnostic tool alone;

employing the diagnostic tool to move at least one sleeve within the borehole casing based on the production profile, said employing to affect fluid communication through at least one aperture of the borehole casing to at least one production region adjacent thereto; and running a confirmation log with the diagnostic tool to determine a condition at the at least one aperture, the condition indicative of the affect on the fluid communication by said employing.

9. The method of claim 8, further comprising determining an affect on the production profile with the diagnostic tool following said employing.

10. The method of claim 8, further comprising determining an affect on the production profile with the diagnostic tool following said employing.

11. An apparatus comprising:

a shaft;

a diagnostic implement coupled to said shaft, said diagnostic implement to log segments of the well for substantially alone establishing a production profile of the well; and a sleeve shifting device coupled to said shaft, said sleeve shifting device to move the sleeve within the well, wherein said sleeve shifting device is expandable for engaging and moving the sleeve and retractable for disengaging the sleeve.

12. The apparatus of claim 11, wherein the sleeve shifting device moves the sleeve based on logging information obtained from the log.

13. The apparatus of claim 11, wherein the diagnostic implement is configured to provide information that is one of fluid flow information, gas flow information, imaging information, fluid velocity information, pressure information, and temperature information.

* * * * *